US006328355B1

(12) United States Patent
Bortz

(10) Patent No.: US 6,328,355 B1
(45) **Date of Patent: *Dec. 11, 2001**

(54) SECURITY SEAL

(75) Inventor: Gary Bortz, North Rydo (AU)

(73) Assignee: Harcor Security Seals Pty Limited, New South Wales (AU)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/054,902

(22) Filed: Apr. 3, 1998

(30) Foreign Application Priority Data

Apr. 9, 1997 (AU) ..... PO6170

(51) Int. Cl.[7] ..... B65D 55/02; B65D 55/06

(52) U.S. Cl. ..... 292/307 R; 292/322; 206/1.5; 220/265; 220/266; 220/324

(58) Field of Search ..... 220/266, 270, 220/265, 324; 292/307 R, 307 A, 318, 321, 322, 327; 24/615, 616; 215/253, 258; 206/1.5

(56) References Cited

U.S. PATENT DOCUMENTS

| | | | | |
|---|---|---|---|---|
| 77,563 | * | 5/1868 | Adams | 292/25 |
| 79,801 | * | 7/1868 | Adams | 292/153 |
| 1,179,005 | * | 4/1916 | Hedge | 292/318 |
| 1,246,748 | * | 11/1917 | Johnson | 215/14 |
| 1,700,744 | * | 2/1929 | Murray, Jr. | 292/307 R |
| 3,149,869 | * | 9/1964 | Chamberlin | 292/320 |
| 3,391,820 | * | 7/1968 | Neal | 220/270 |
| 4,042,267 | * | 8/1977 | Clinch et al. | 292/318 |
| 4,106,801 | * | 8/1978 | De Lima Castro Neto | 292/307 R |
| 4,212,415 | * | 7/1980 | Neely | 220/324 |
| 4,299,417 | | 11/1981 | McClure . | |
| 4,423,822 | * | 1/1984 | Powalowski | 215/253 X |
| 4,509,654 | * | 4/1985 | Maguire | 215/258 |
| 4,564,115 | * | 1/1986 | Imbert | 220/270 X |
| 4,607,759 | * | 8/1986 | Boetzkes | 220/266 X |
| 4,664,432 | * | 5/1987 | Swift | 292/318 X |
| 4,721,210 | * | 1/1988 | Lawrence et al. | 220/266 X |
| 4,763,732 | * | 8/1988 | Neal | 220/266 X |
| 4,782,977 | * | 11/1988 | Wantanabe et al. | 220/324 |
| 4,801,030 | * | 1/1989 | Barriac | 215/258 X |
| 4,896,926 | * | 1/1990 | Verholt | 220/4.26 |
| 4,934,554 | * | 6/1990 | Edwards | 220/266 |
| 4,974,735 | * | 12/1990 | Newell et al. | 215/237 X |
| 4,978,017 | * | 12/1990 | McBride | 215/258 X |
| 5,085,476 | * | 2/1992 | Fuehrer | 297/307 R |
| 5,129,531 | * | 7/1992 | Beck et al. | 220/270 X |
| 5,427,260 | * | 6/1995 | Mueller et al. | 215/254 |
| 5,893,475 | * | 4/1999 | May | 215/48 |

FOREIGN PATENT DOCUMENTS

| | | |
|---|---|---|
| 70338 | 10/1977 | (AU) . |
| B-64606/90 | 10/1989 | (AU) . |
| S-117081 | 10/1992 | (AU) . |
| 476 925 | 8/1969 | (CH) . |
| G 92 00 110.6 | 3/1992 | (DE) . |
| 024918 | 6/1979 | (GB) . |
| WO 96/28804 | 3/1996 | (WO) . |

* cited by examiner

*Primary Examiner*—Gene Mancene
*Assistant Examiner*—Joseph C Merek
(74) *Attorney, Agent, or Firm*—Welsh & Katz, Ltd.

(57) ABSTRACT

The invention provides a security seal having a first portion and a second portion separated from the first portion by at least one line of weakness. The first portion has at least one detent. The first and second portions lie in a single plane and each detent protrudes out of that plane. The invention also provides a container and lid combination, comprising a container having a first compartment for containing foods and a second compartment isolated from the first compartment. The combination has a lid capable of sliding onto the container to cover both the first and second compartments. The second compartment has an aperture for receiving a security seal. The lid includes a third compartment adapted to mate with the second compartment.

6 Claims, 5 Drawing Sheets

Figure 4
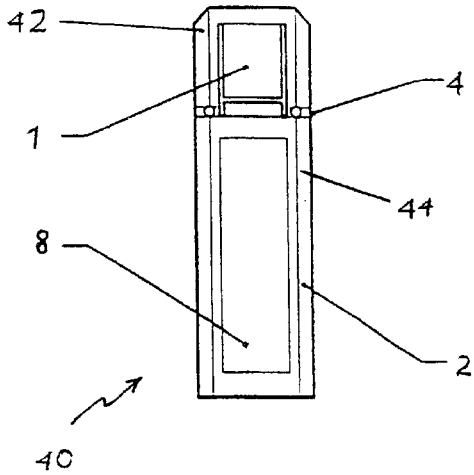
Figure 3
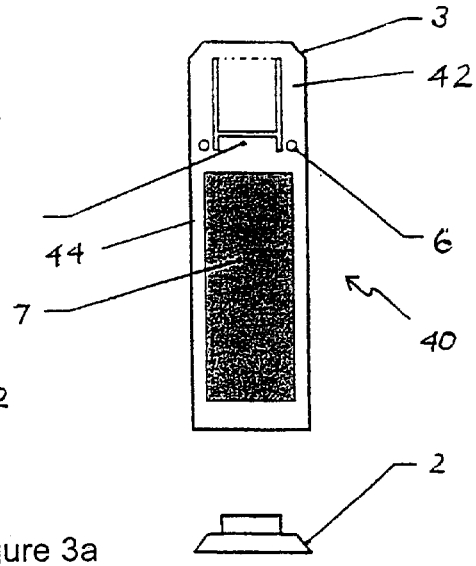
Figure 3a
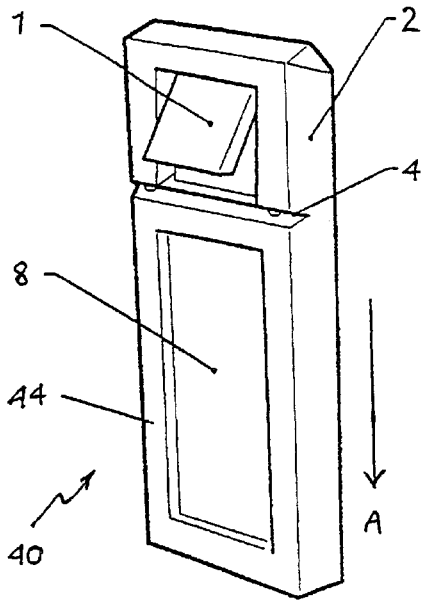
Figure 1
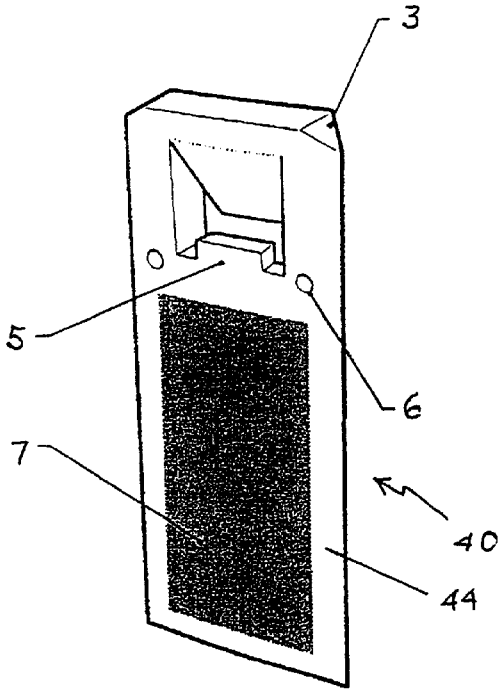
Figure 2

Figure 5
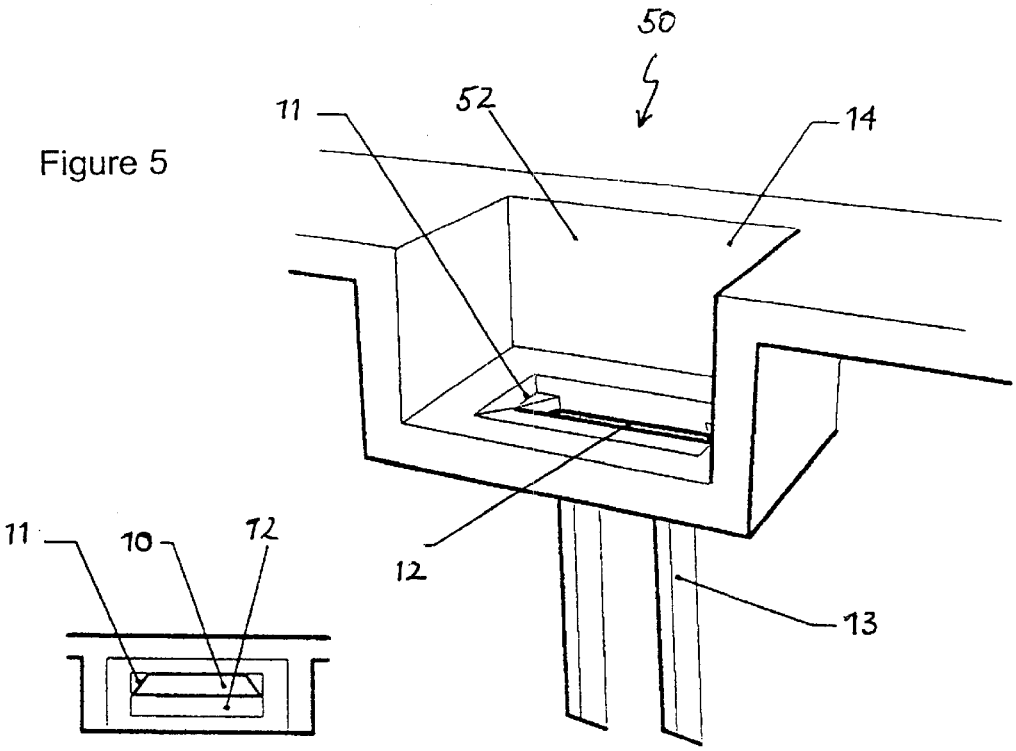
Figure 6
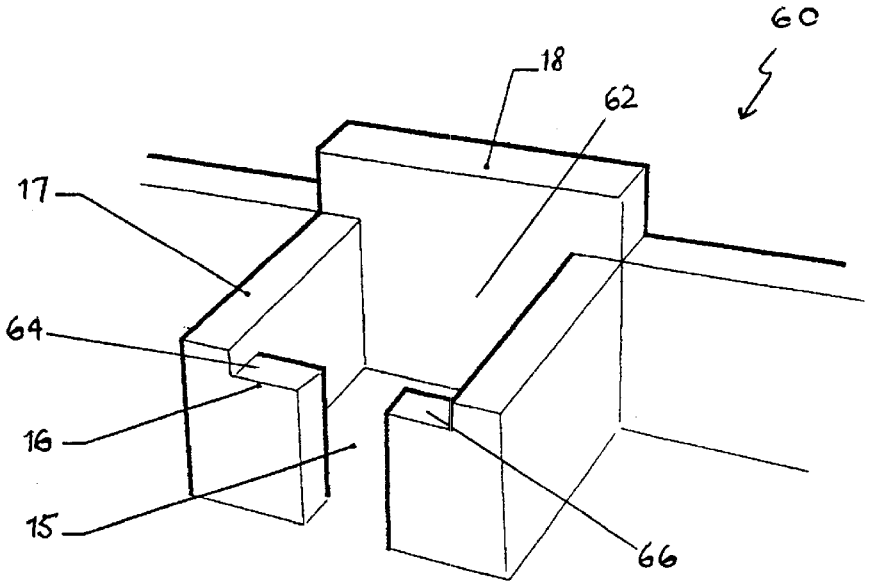
Figure 7

Figure 8
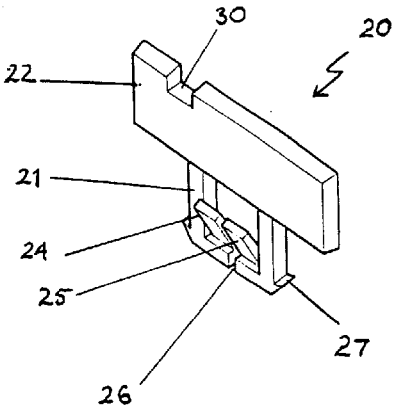
Figure 9
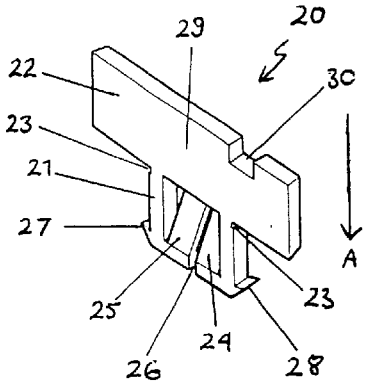
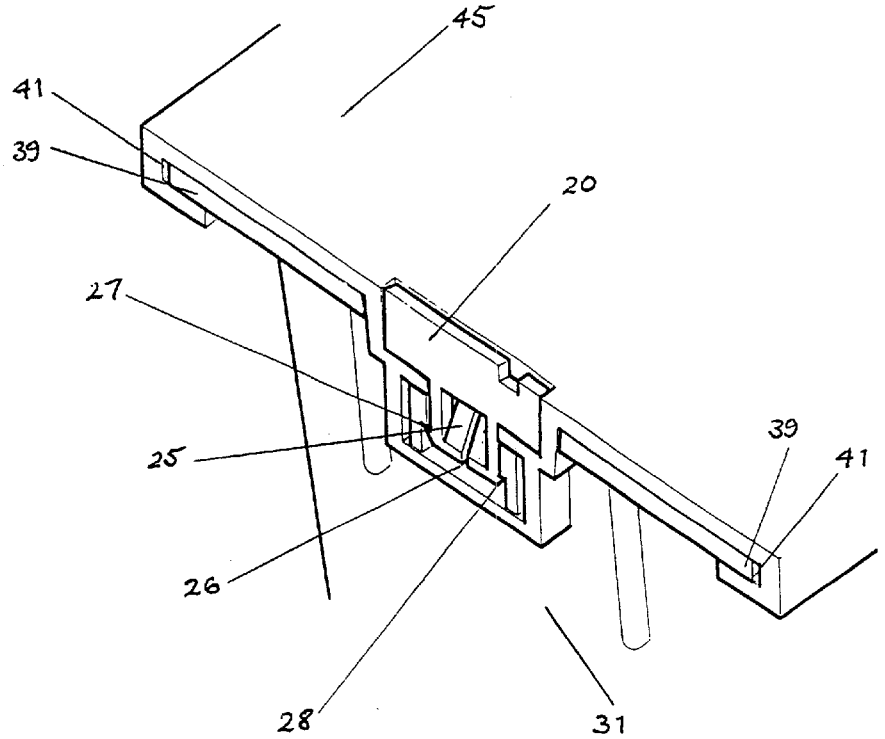
Figure 10

SECURITY SEAL

This invention relates to a security seal, especially suitable for use with cash boxes. In particular, this invention is concerned with a security seal which presents obstacles to tampering and/or which can indicate that tampering has taken place.

Although the description below will deal with cash boxes, it is to be understood that this invention is not limited thereto.

It is known (for example, with reference to Australian Registered Design No. 70338 and Australian Patent No. 648044) to use a cash box with a hinged lid having a closure into which may be inserted a frangible seal. The closure includes a first aperture in a flange or lip for the lid, the first aperture overlying a second aperture in a flange or lip for the base of the box when the lid is closed. When a frangible seal is inserted though the first and second apertures, detents associated with the second aperture prevent withdrawal of the frangible seal. In addition, the lower part of the seal is inaccessible. In order to open the box, the seal must be broken. Because the first and second apertures are located externally of the compartment in which cash is stored, it would be immediately apparent upon inspection of the cash box if the seal had been tampered with.

It is also known (from Australian Registered Design No. 117081) to provide a cash box with a sliding, instead of a hinged, lid. When the lid slides to a closed position over the cash compartment, a first aperture in a flange or lip for the lid overlies a second aperture in a flange or lip for the base of the box. When a frangible seal is inserted though the first and second apertures, detents associated with the second aperture prevent withdrawal of the frangible seal. In addition, the lower part of the seal is inaccessible. In order to open the box, the seal must be broken and consequently inspection of the cash box will reveal whether tampering has taken place.

In the case of Australian Registered Design No. 70338, the seal is inserted into the first and second apertures from above. When the seal is broken, the lower half can fall from the closure and be lost.

In the case of Australian Patent No. 648044, the seal is also inserted into the first and second apertures from above. However, in one embodiment, the lower part of the broken seal is retained, to be ejected when the lid is opened.

In the case of Australian Registered Design No. 117081, once again the seal is inserted into the first and second apertures from above. The lower part of the seal, when broken, can fall from the closure and be lost.

The seals used in connection with the prior art containers have taken one general form: the detents have protruded to each side of the seal and so have remained in the same plane as the seal.

It is an object of the present invention to provide an improved security seal and an improved container and lid combination.

Accordingly, in one aspect, this invention comprises a security seal having a first portion and a second portion separated from the first portion by at least one line of weakness, the first portion having at least one detent, wherein the first and second portions lie in a single plane and the or each detent protrudes out of that plane.

This invention also provides a container and lid combination, comprising a container having a first compartment for containing goods and a second compartment isolated from the first compartment; and a lid capable of sliding onto the container to cover both the first and second compartments, wherein the second compartment has an aperture for receiving a security seal and the lid includes a third compartment adapted to mate with the second compartment.

The container and lid in the combination of the invention may be made of any suitable material. Preferably, the material chosen has a certain amount of rigidity and strength as well as a degree of brittleness. One suitable material, for example, is medium density styrene. Another suitable material is a polycarbonate or a glass-filled polycarbonate. Preferably, the container and lid are made of a relatively transparent material, so that the general nature of the contents can be ascertained by inspection. It is also preferred that the material of the container and lid is sufficiently robust to avoid accidental breakage under normal circumstances.

Preferably, the container and lid combination of the invention is adapted to receive the security seal of the invention.

The security seal may have a single detent or a plurality of detents. In one preferred embodiment, the seal has a single detent which comprises a leaf spring formed in the first portion of the seal. In another embodiment, the seal has a pair of detents each comprising a leaf spring formed in the first portion of the seal. However, it is within the scope of this invention that more than two detents may be provided. In addition, the or each detent may take the form of a barb.

The seal of the invention may include one or more barbs separate from each detent.

Where there are two or more detents, they may be spaced from one another or otherwise arranged so that when the seal is broken the detents separate.

The first portion may be shorter or narrower than the second portion, which may include a large printable area for serial numbers or similar unique identification of the seal.

To avoid the possibility of someone breaking the seal of the invention and then attempting to glue the first and second portions of the seal together, it may be desirable to reduce or minimise the seal material along the or each weakness line, so that the join area is small.

Each line of weakness is preferably a score line formed between the first and second portions, but may take any other suitable form, such as one or more holes or depressions in the line of weakness.

In the container and lid combination of the invention, the second and third compartments may be completely enclosed, may omit a wall or may have a gap in at least one wall—for example, to accommodate the or each detent. The second compartment may mate with the third compartment by being received within the third compartment, or vice versa.

Preferably, the container of the combination of the invention is shaped so that, when empty, a plurality of containers may nest together. It is also preferred that the lid includes locating lugs or ridges or other means which can enable a plurality of containers, with lids attached, to be stacked one above the other. For example, the side walls of a first container may taper inwardly towards the base of the container, the base being adapted to fit within locating lugs or ridges on the lid of a container stacked underneath the first container.

The invention will now be described with reference to preferred embodiments thereof as illustrated in the accompanying drawings, in which:

FIG. 1 is a perspective rear view of a first embodiment of the seal of the invention;

FIG. 2 is a perspective front view of the seal of FIG. 1;

FIG. 3 is a front elevation of the seal of FIG. 1;

Figure 11:
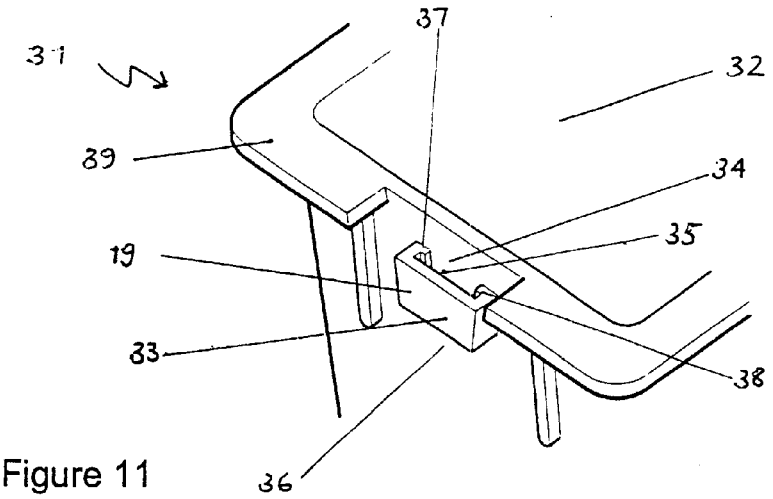
Figure 12:
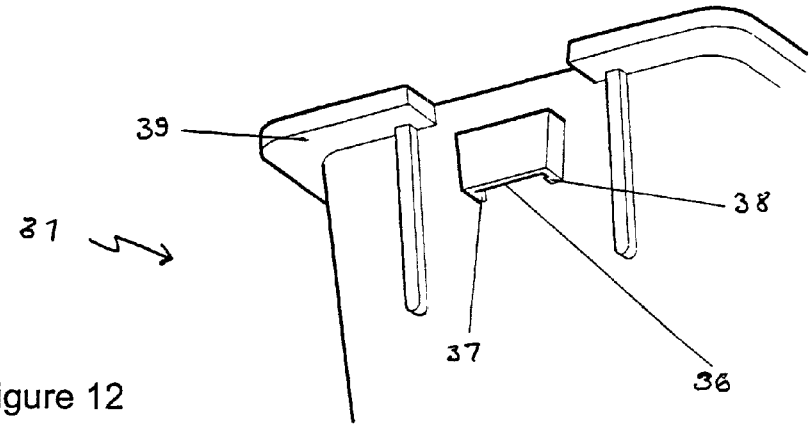
Figure 15:
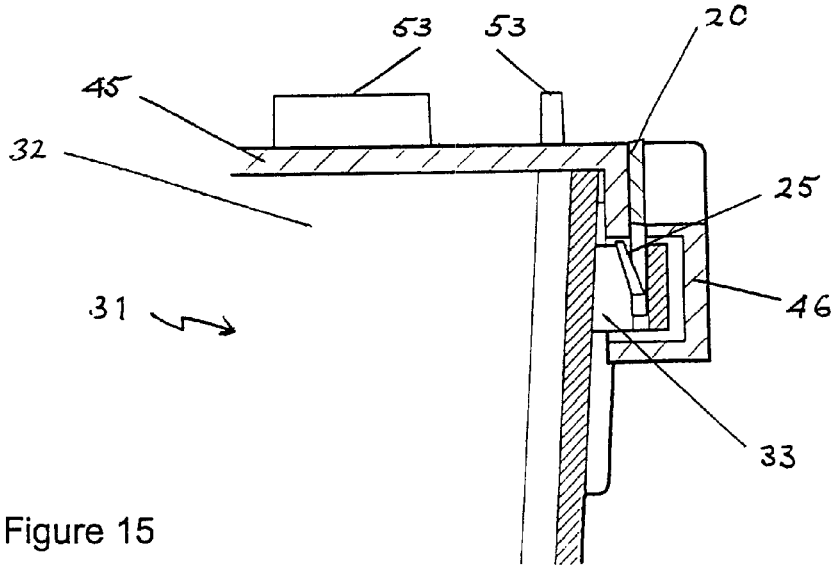
Figure 14:
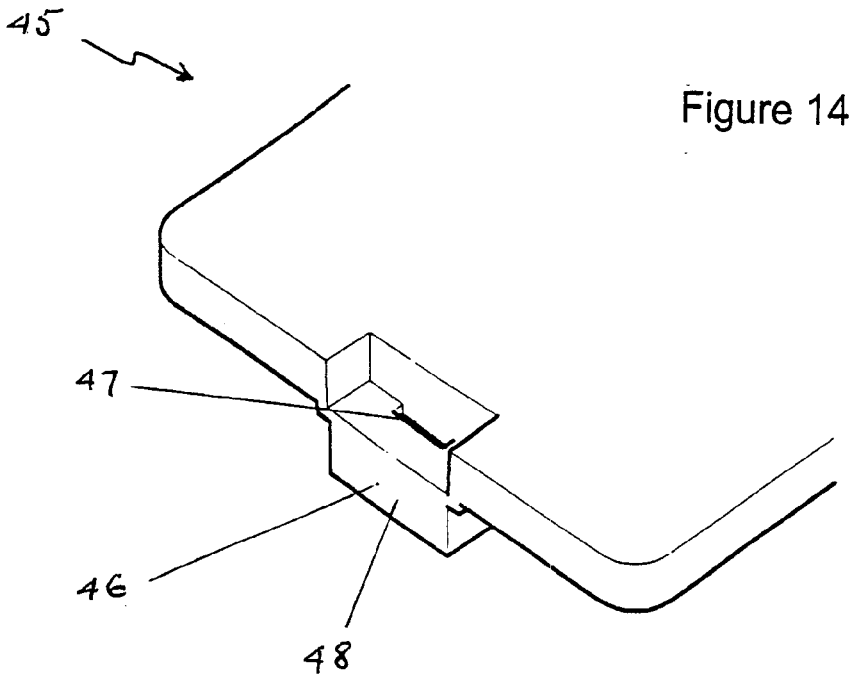
Figure 13:
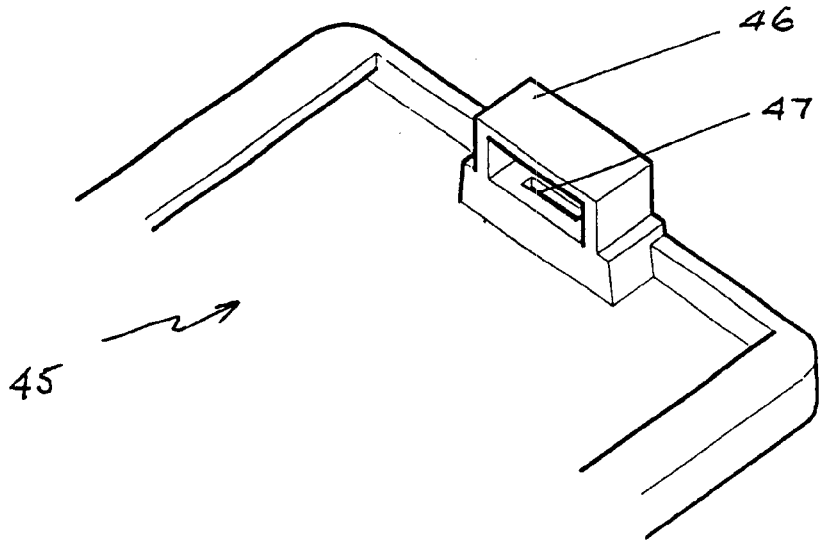

FIG. 3*a* is a top view of the seal of FIG. 3;

FIG. 4 is a rear elevation of the seal of FIG. 1;

FIG. 5 is a partial perspective view of a first embodiment of the container according to the invention, featuring the second compartment;

FIG. 6 is a plan view of the second compartment in FIG. 5;

FIG. 7 is a perspective view of a first embodiment of the lid according to the invention, featuring the third compartment, viewed from inside the lid in an upside down position;

FIG. 8 is a perspective rear view of a second embodiment of the seal of the invention;

FIG. 9 is a perspective front view of the seal of FIG. 8;

FIG. 10 shows in perspective view the seal of FIG. 8 in position locking the container and lid combination of FIGS. 11 to 14, with certain parts omitted for convenience;

FIG. 11 is a partial perspective view from above of a second embodiment of the container according to the invention, featuring the second compartment;

FIG. 12 is a partial perspective view from below of the container of FIG. 11;

FIG. 13 is a perspective view of a second embodiment of the lid according to the invention, featuring the third compartment, viewed from inside the lid in an upside down position;

FIG. 14 is a perspective view of the lid of FIG. 13, viewed from above with the lid in the upright position; and FIG. 15 is a sectional side elevation of the container of FIGS. 11 to 12 and the lid of FIGS. 13 and 14, assembled with the seal of FIGS. 8 and 9 in place.

Referring first to FIGS. 1 to 4, seal 40 has a first portion 42 and a second portion 44. Second portion 44 is separated from first portion 42 by a line of weakness 4, which is a score line assisting correct breaking of seal 40 into parts 42 and 44.

First portion 42 has a detent or tab 1 being a leaf spring which projects out of the plane A (see FIG. 1) in which first portion 42 and second portion 44 lie. Barrier 5 serves to prevent tampering with detent 1 by limiting the range of travel of detent 1.

Seal 40 includes a large printable area 7 on which may be recorded a serial number, or similar unique identification.

As can be seen in FIGS. 2 and 3, seal 40 has two holes 6 in line of weakness 4, to minimise the seal material in line of weakness 4 and to make it more difficult to attempt to join first portion 42 to second portion 44 after they have broken apart.

Seal 40 has tapered sides 2 to ensure that seal 40 is correctly inserted in slot 10 of container 50 (see FIG. 6). In addition, seal 40 has tapered upper corners 3, to assist insertion of seal 40 in slot 10. Recess 8 serves to reduce the quantity of material necessary for seal 40 and can also be used to house identifying numbers.

Turning now to FIG. 5, container 50 has a first compartment (not shown) for containing goods, such as bank notes, and a second compartment 52 which is isolated from the first compartment by wall 14. Second compartment 52 includes an aperture or slot 10 (refer especially FIG. 6) adapted to receive seal 40.

Ribs 13 are mounted on the outside wall of the first compartment, and serve to space seal 40 away from wall 14, thus making it easier to grip seal 40.

As shown in FIG. 6, slot 10 has a tapered profile to ensure that seal 40 is inserted correctly (i.e., not back-to-front). Tapered edge 11 is formed only half way through the material of slot 10, to aid ejection of the second portion 44 of seal 40 after it is broken from first portion 42. Similarly, ramp 12 into slot 10 aids ejection of second portion 44.

Turning now to FIG. 7, container lid 60 is adapted to slide on to container 50. When lid 60 is in position, it will cover both the first compartment and second compartment 52, with third compartment 62 being received with second compartment 52.

As can be seen in FIG. 7, third compartment 62 has an opening 15 in wall 16, to accommodate detent 1. In addition, wall 16 is designed to lock against seal 40, and has cutaway portions 64 and 66, to aid ejection of second portion 44 of seal 40.

Side walls 17 of third compartment 62 strengthen end wall 16 and prevent tampering with seal 40 when in position.

Front wall 18 of third compartment 62 is elongated to overlap the front of third compartment 62 and prevent tampering.

To operate the seal and container and lid of the invention, after bank notes or other goods are placed in the first compartment of container 50, lid 60 is slid into position over the first compartment and second compartment 52, with third compartment 62 being received in second compartment 52. Seal 40 is then inserted into slot 10 from below container 50, optionally sliding along ribs 13. Detent 1 will close up during insertion into slot 10, and will spring open again as soon as detent 1 has cleared slot 10. Thus, first portion 42 of seal 40 will be retained inside compartments 52 and 62. Front wall 18 limits access to the compartments 52 and 62.

If an attempt is made to open lid 60, wall 16 of lid 60 will bear against seal 40 and continued pressure will cause seal 40 to break at line of weakness 4, breaking seal 40 into first portion 42 and second portion 44. First portion 42 will be retained in compartment 52, thus remaining separate from any goods in the first compartment and being easily locatable. Second portion 44 will be ejected from slot 10. The absence of second portion 44 will immediately signal that tampering has occurred.

Referring now to FIGS. 8 and 9, seal 20 has a first portion 21 and a second portion 22. First portion 21 is separated from second portion 22 by a V groove 23 (refer FIG. 9).

First portion 21 has a pair of detents or spring action legs 24 and 25, which project out of plane A (refer FIG. 9) in which first portion 21 and second portion 22 lie. Detents 24 and 25 are tapered towards their upper ends to increase their spring. Detents 24 and 25 are separated by gap 26. Gap 26 provides the means whereby detents 24 and 25 can be compressed towards each other during insertion of seal 20.

Seal 20 also includes side barbs 27 and 28.

Seal 20 includes printable area 29; printing on seal 20 is facilitated by the use of locating notch 30.

Turning now to FIGS. 11 and 12, container 31 has a first compartment 32 which, as in the previous embodiment, can contain goods such as bank notes, and a second compartment 33, which is isolated from first compartment 32 by wall 34. Second compartment 33 has an upper opening 35 communicating with a lower opening 36 through which detents 24 and 25 can fall once they have been broken away from second portion 22. Second compartment 33 includes returns 37 and 38, to restrict lateral movement of seal 20 when inserted in second compartment 33. Flange 39 is for the purpose of mounting lid 45 (see below).

With reference to FIGS. 13 and 14, lid 45 is adapted to slide onto container 31 by sliding flange 39 into channel 41 (refer FIG. 10). When lid 45 is in position, it will cover both first compartment 32 and second compartment 33, second compartment 33 being received within third compartment 46.

When lid 45 is slid into position on container 31, slot 47 in third compartment 46 lines up with upper opening 35 and lower opening 36 in container 31. Seal 20 can be inserted from above into slot 47, upper opening 35 and lower opening 36. The mating between second compartment 33 and third compartment 46 is snug, to prevent lid 45 from inadvertently sliding off container 31 before seal 20 is inserted. After insertion of seal 20 into slot 47, side barbs 27 and 28 project out of lower opening 36, as can be seen in FIG. 10 (which omits front wall 48 of third compartment 46 and front wall 19 of second compartment 33). Detents 24 and 25 retain seal 20 inside compartments 33 and 46 and hold container 31 and lid 45 in a closed configuration. In order to open container 31 by sliding lid 45, it is necessary to exert pressure on seal 20 by breaking detents 24 and 25 on first portion 21 from second portion 20 along groove 23. Detents 24 and 25 are designed to fall free of lower opening 36 and their absence upon authorised opening of container 31 is an indication of unauthorised tampering.

As can be seen in FIG. 15, lid 45 has locating lugs 53 spaced around the perimeter of lid 45, to facilitate stacking of container and lid combinations, one on the other. Locating lugs 53 have been omitted from FIG. 14, for simplicity. However, by way of example, there may be eight such locating lugs around the perimeter, two on each side.

As will be readily appreciated by one skilled in the art, the seal of the present invention in its various embodiments can be used with the lid and container combination of the present invention, in various embodiments. However, the seal of the invention is not limited to use with the container and lid combination of the invention. For example, the seal can be used on an appropriately designed reusable bag, rather than in connection with a container.

Other embodiments will be apparent to one skilled in the art and are within the scope of this invention.

What is claimed is:

1. A security seal for use with an associated container and lid combination wherein the seal indicates tampering with the combination, said container and having a stop surface, the stop surface being adjacent an aperture on the container, said security seal being initially not associated with said combination and having a first portion, and a second portion separated from said first portion by at least two lines of weakness, the first portion including two or more tabs, said tabs lying in a first plane at rest, said tabs extending outwardly and upwardly towards the second portion, said first and second portions lying in a second plane and said tabs being out of said second plane when at rest and deformable into said second plane, wherein said security seal is insertable into said aperture and said tabs are retained in said aperture by said stop surface when at rest to resist removal of said security seal from said aperture, and said tabs will move from said first plane to said second plane and return to said first plane when said seal is inserted into said aperture.

2. A security seal as claimed in claim 1, wherein said tabs each comprise a leaf spring formed in the first portion of the seal.

3. A security seal as claimed in claim 2 wherein each tab is spaced from the other or otherwise arranged so that when the seal is broken the tabs separate from each other.

4. A security seal as claimed in claim 1 wherein the seal is reduced along the or each line of weakness.

5. A security seal as claimed in claim 4, wherein each line of weakness is a score line or groove formed between the first and second portions.

6. A security seal as claimed in claim 1 which also includes one or more barbs.

* * * * *